United States Patent [19]

Morgachev et al.

[11] 4,264,357

[45] Apr. 28, 1981

[54] WEAR-RESISTANT CAST IRON

[76] Inventors: Ivan G. Morgachev, ulitsa Kuprina, 42, kv. 33; Vyacheslav N. Popov, ulitsa Stadionnaya, 18, kv. 63; Sergei P. Bessarabov, ulitsa 50-letia SSSR, 103, kv. 23; Valery P. Stoiko, bulvar Pushkina, 7, kv. 36; Anatoly P. Ivanov, ulitsa Kuprina, 50, kv. 25, all of Donetsk, U.S.S.R.

[21] Appl. No.: 80,306

[22] Filed: Oct. 1, 1979

Related U.S. Application Data

[63] Continuation of Ser. No. 966,061, Dec. 4, 1978, abandoned.

[51] Int. Cl.[3] ..... C22C 37/08

[52] U.S. Cl. ..... 75/128 D; 75/128 T; 148/35

[58] Field of Search ..... 75/128 D, 128 T; 148/35

[56] References Cited

U.S. PATENT DOCUMENTS

| | | | |
|---|---|---|---|
| 3,334,996 | 8/1967 | Foster et al. | 75/128 D |

FOREIGN PATENT DOCUMENTS

| | | | |
|---|---|---|---|
| 2149772 | 1/1974 | Fed. Rep. of Germany . | |
| 42-43700 | 6/1967 | Japan | 75/128 D |
| 46-26214 | 7/1971 | Japan | 75/128 D |
| 49-672 | 1/1974 | Japan . | |
| 51-61422 | 5/1976 | Japan | 75/128 D |
| 309971 | 5/1969 | U.S.S.R. | 75/128 D |
| 312708 | 8/1971 | U.S.S.R. | 75/128 D |
| 377221 | 4/1973 | U.S.S.R. . | |
| 383738 | 8/1973 | U.S.S.R. | 75/123 CB |

OTHER PUBLICATIONS

Petrov, I. V., Itogi Nauki, Svarka Series, Metallurgiya, Publishers, 1969, p. 58, Table 2.

*Primary Examiner*—R. Dean
*Attorney, Agent, or Firm*—Fleit & Jacobson

[57] ABSTRACT

Wear-resistant cast iron comprising the following ingredients (wt. %):

| | |
|---|---|
| carbon | from 3.0 to 3.5 |
| silicon | from 0.6 to 1.5 |
| manganese | from 0.8 to 1.5 |
| chromium | from 23.0 to 27.0 |
| nickel | from 3.0 to 3.5 |
| titanium | from 0.6 to 1.0 |
| iron and impurities | the balance |

1 Claim, No Drawings

WEAR-RESISTANT CAST IRON

This is a continuation of application Ser. No. 966,061, filed Dec. 4, 1978 now abandoned.

BACKGROUND OF THE INVENTION

1. Field of the Invention

The present invention relates to metallurgy and, particularly, to wear-resistant cast irons with high chromium content. Such cast irons can be used for manufacturing or reconditioning machine parts exposed to abrasive or abrasive and impact wear, for example, bucket teeth of rotary and other types of excavators, working members of hammer and jaw breakers, tools for drilling sedimentary rock, blades of bulldozers and scrapers. The above-mentioned parts or their working portions can be manufactured or reconditioned using the cast iron of the proposed composition mainly by electroslag remelting of ferrous electrodes in moulds the bottom and walls of which have the form corresponding to that of manufactured or reconditioned parts.

2. Description of the Prior Art

Wear-resistant cast irons with high chromium content are known in the art. Their wide use in present-day technology is determined, first, by their low cost as compared to that of diamond tools and tools made from hard alloys based on carbides of high melting metals such as tungsten, titanium and tantalum, second, by their sufficiently high impact strength, which quality is especially important in application involving impact loads and, third, by their adequate resistance to abrasive wear.

For example, an accepted Japanese Application No. 49-672 (Nat. class 12 B 151, 1974) describes a wear-resistant cast iron used for electric-arc surfacing of worn parts. This cast iron contains (wt.%) from 2.5 to 3.5 of carbon, from 0.5 to 2.0 of silicon, from 0.1 to 1.0 of manganese, from 5.0 to 20.0 of chromium, from 0.4 to 1.5 of boron, less than 1.0 of nickel, and the balance of iron and impurities.

Such cast iron is suitable for comparatively thin surface layers of parts abraded by contact with other metal or metal alloy parts, for example, for surfacing exhaust valve stem ends in internal combustion engines.

The use of such cast iron for manufacturing parts or components of machine parts exposed to impact and abrasive wear is impracticable due to an inadequate mechanical strength of said cast iron.

There is also known a higher-strength wear-resistant cast iron which can be used for manufacturing new or reconditioning used parts intended for service under impact and abrasive or abrasive wear conditions. This cast iron contains (wt.%) about 3.0 of carbon, about 1.0 of silicon, about 1.5 of manganese, up to 20.0 of chromium, about 0.5 of molibdenum, and the balance of iron and impurities (see Petrov I.V. "Primenenie iznosostoikikh naplavok dlya povysheniya dolgovechnosti rabochikh organov stroitelno-dorozhnykh mashin" in "Itogi Nauki" collected papers, "Svarka" Series, "Matallurgiya" Publishers, 1969).

However, parts made with the use of the above wear-resistant cast iron have a poor impact load resistance, this resulting in numerous cleavage fractures in surface layers and irregular distortions of the shape of said parts. The loss of specified shape by said parts causes higher both dynamic loads on machines concerned and specific energy consumption, this necessitating the replacement of said parts before they are actually worn out.

The most suitable for above application from among prior art ones is the Sormite I wear-resistant cast iron (see USSR State Standard GOST 21448-55) containing the following ingredients (wt.%):

| | |
|---|---|
| carbon | from 2.5 to 3.3 |
| silicon | from 2.8 to 3.5 |
| manganese | up to 1.5 |
| chromium | from 25 to 31 |
| nickel | from 3 to 5 |
| iron and impurities | the balance |

When deposited in a thin layer on parts made from tough shock-resistant steels, this cast iron has good impact and abrasion resistance. However, due to a high silicon content and a coarse-grained microstructure, said cast iron exhibits a rather high brittleness in layers the thickness of which is comparable to or is larger than that of the steel portion of the part. Therefore, the use of such cast iron as a main structural material of working portions, for example, bucket teeth tips of rotary excavators, heads of breaker hammers and similar parts can result in a rapid failure of these working portions under impact loads.

A combined impact and abrasive action exerted on such parts having working portions from Sormite I reduces steel further the useful life thereof.

SUMMARY OF THE INVENTION

The main object of the invention is to improve the resistance of cast iron to impact and abrasive wear.

An additional object of the invention is to increase the useful life of machine parts manufactured using wear-resistant cast iron, such as bucket teeth of rotary excavators, working members of hammer and jaw breakers, bulldozer and scraper blades, and the like.

The above objects are attained by that a wear-resistant cast iron containing carbon, silicon, manganese, chromium, nickel, iron, and impurities, according to the invention, additionally contains titanium, said ingredients being taken in the following proportions (wt.%):

| | |
|---|---|
| carbon | 3.0 to 3.5 |
| silicon | 0.6 to 1.5 |
| manganese | 0.8 to 1.5 |
| chromium | 23.0 to 27.0 |
| nickel | 3.0 to 3.5 |
| titanium | 0.6 to 1.0 |
| iron and impurities | the balance |

The use of silicon in amounts not exceeding 1.5 wt.% and the inclusion of titanium materially improves the microstructure of wear-resistant cast iron, reduces the brittleness thereof and increases its resistance to impact and abrasive action.

Wear-resistant cast iron of the chemical composition according to the invention can be produced in arc or induction furnaces with basic lining by melting of the charge comprising grey conversion cast iron, low carbon (below 0.3 wt.%) steel scrap, ferrochromium, ferromanganese, ferrosilicon, metallic nickel and ferrotitanium (or metallic titanium).

The process begins with charging grey conversion cast iron in pigs and steel scrap into an electric furnace having a melting space temperature of about 1000° C. As the melting of the charged ingredients proceeds, the electric furnace is further charged with small portions (15 to 25% from the calculated amount) of ferrochromium and to the obtained chromium-containing melt nickel is added. Upon melting of all the above ingredients and homogenation of the melt, the electric furnace is charged with burnt limestone in an amount of about 5% of the mass of the charge and the contents of the electric furnace is heated to a temperature of 1430°±50° C. for I to 1.5 hours until a flowable slag is formed. To increase slag flowability, fluorite can be introduced into the furnace in an amount of up to 3% of the mass of the slag. Ferromanganese is added to the metal melt, and on melting thereof ferrosilicon is introduced thereto if necessary. After slag removal, the electric furnace is charged with titanium (or ferrotitanium). The melt is homogenized and the produced wear-resistant cast iron is tapped.

It is most preferable to pour the obtained wear-resistant cast iron into moulds the volume of which corresponds to that of stick electrodes for manufacturing machine parts by electroslag remelting process. The parts required can also be produced by a direct casting of fluid wear-resistant cast iron into sand moulds.

Articles made from wear-resistant cast iron of the chemical composition according to the invention have the following characteristics:

| | |
|---|---|
| hardness, HRC | from 48 to 55 |
| cross-breaking strength, kgf/mm$^2$ | from 71 to 75 |
| bending deflection, mm, measured on breakage of 340 × 40 × 20mm specimen | about 3.45 |

For better understanding of the present invention examples are hereinafter given of the compositions of wear-resistant cast iron of the subject invention.

DETAILED DESCRIPTION OF THE INVENTION

EXAMPLE 1

Wear-resistant cast iron comprises the following ingredients (wt.%):

| | |
|---|---|
| carbon | 3.0 |
| silicon | 0.6 |
| manganese | 0.8 |
| chromium | 23.0 |
| nickel | 3.0 |
| titanium | 0.6 |
| iron and impurities | the balance |

This wear-resistant cast iron contains up to 0.05 wt.% of sulphur and up to 0.05 wt.% of phosphorus as controlled impurities.

The above wear-resistant cast iron is obtained by the charge comprising the following ingredients (wt.%):

| | |
|---|---|
| conversion cast iron | 12.8 |
| steel scrap | 44.6 |
| ferrochromium | 35.2 |
| ferromanganese | 0.9 |
| nickel | 2.5 |
| titanium | 4.0 |

For correcting the chemical composition of the wear-resistant cast iron by comparison to the data of rapid analysis of melt samples, up to 2% of ferrosilicon of the total mass of the above charge ingredients can be used.

Chemical composition of the above charge ingredients is given in Table 1.

TABLE 1

| Charge ingredients | Chemical elements and their concentration in charge ingredients, wt. % | | | | | | | | | | |
|---|---|---|---|---|---|---|---|---|---|---|---|
| | Fe | C | Si | Mn | Cr | Ni | Ti | S | P | Cu | As |
| Conversion cast iron AK-4 | 93.15 | 4.0 | 2.2 | 0.50 | — | — | — | 0.02 | 0.13 | — | — |
| Steel scrap CT.3 | 98.48 | 0.18 | 0.12 | 0.5 | 0.2 | 0.15 | — | 0.05 | 0.04 | 0.2 | 0.08 |
| Ferrochromium | 18.7 | 7.8 | 1.3 | 0.8 | 71.4 | — | — | — | — | — | — |
| Ferromanganese | 18.89 | 6.0 | 1.9 | 73.0 | — | — | — | 0.01 | 0.20 | — | — |
| Nickel H 1 | — | — | — | — | — | 99.99 | — | — | — | — | — |
| Titanium BT1-100 | — | — | — | — | — | — | 99.99 | — | — | — | — |
| Ferrosilicon | 54.82 | — | 44.0 | 0.6 | 0.5 | — | — | 0.03 | 0.05 | — | — |

The required amounts of charge ingredients were calculated by a conventional method based on furnace crucible capacity and the data on charge composition given hereinabove.

Wear-resistant cast iron melting was performed in an induction furnace comprising a 2.5 ton quartz sand or ground quartzite crucible. Electric capacity of the furnace is 1300 kW.

The calculated amounts of conversion cast iron and steel scrap were charged into the crucible of the induction furnace prepared for operation in a conventional manner and gradually melted down for 40 to 50 min with the melt temperature being brought to 1430° C.

Into the melt thus obtained was introduced ferrochromium in five portions each amounting 20% of the calculated quantity. The introduction was completed within an hour, each subsequent portion being introduced on melting of the preceeding one. To the above chromium-containing melt a calculated amount of nickel was added and melted down, and the melt was held at 1430° to 1450° C. for I to 1.5 hour. During this period, to prevent the crucible lining erosion, limestone in an amount of up to 5% of the total mass of the charge was introduced into the crucible and fluorite in an amount of 3% of the total mass of the charge was added to reduce the viscosity of the charge. The slag protects the melt from oxidation and facilitates gas removal therefrom.

25 to 30 min melt cycle completion, the slag was removed, the calculated amount of ferromanganese was added to the melt, and, on melting thereof, melt samples were taken for rapid analysis the results of which were used to correct chemical composition of the melt by adding ferrosilicon.

Immediately before melt tapping, the calculated amount of titanium was introduced therein. The melt was tapped into a preheated ladle.

Hereinabove described is a specific example of melting wear-resistant cast iron of the above-indicated chemical composition. In view of the fact that chemical composition of industrial charge materials is generally characterized by the values somewhat different from those given in Table 1, rapid analysis of melt chemical composition in melting wear-resistant cast iron is to be performed several times and the chemical composition can be corrected not only by adding ferrosilicon but other ferroalloys as well. During each sampling the furnace is switched off for 10 to 20 min, that is for the time required for a rapid analysis.

By pouring into well dried sand-loam moulds the obtained wear-resistant cast iron was made into slab and rod shaped blanks 10 to 15 mm thick used furhter to produce, by electroslag remelting, specimens used in determining Rockwell hardness, cross-breaking strength, bending deflection of specimens on breakage, the coefficient of relative abrasive wear-resistance and the coefficient of relative impact and abrasive wear resistance.

The hardness was determined by a conventional procedure using Rockwell hardness tester on flat specimens 10 mm thick.

Cross-breaking strength was measured on static loading of cylinder shaped specimens 30 mm in diameter and 650 mm long. The distance between prismatic supports was 600 mm. The load was point-applied in the centre of the specimen.

The same specimens were used on breakage thereof for bending deflection measurements.

The coefficient of relative abrasive wear resistance was determined by abrading on Howorth machine 70×35×20 mm specimens made from wear-resistant cast iron of the chemical composition according to the invention, Sormite I wear-resistant cast iron, and annealed steel 45 used as a standard for comparison. Steel 45 contains from 0.42 to 0.50 wt.% of carbon, the balance being iron and impurities.

Loose granite crumbs of particle size from 2 to 3 mm were used as an abrasive. Each specimen was weighed, abraded for 15 minutes at a load of 150 kgf, weighed again and taking the wear of a steel 45 specimen for a unity, the coefficient of relative abrasive wear resistance Σ was determined from the formula $$\Sigma = \frac{\Delta P_{st45}}{\Delta P_{wci}},$$

$P_{st45}$ is a weight loss of a steel 45 specimen $P_{wci}$ is a weight loss of a wear-resistant cast iron specimen The coefficient of relative impact and abrasive wear resistance was determined by service testing of ERG-400 rotary bucket excavator teeth. This caterpillar excavator has a rotor equipped with nine solid-bottom buckets, each bucket having six teeth with working portion up to 100 mm long.

For testing purposes there were manufactured 6 sets of specimen teeth with working portions formed by electroslag remelting of wear-resistant cast iron of the chemical composition according to the invention and Sormite 1 wear-resistant cast iron (3 sets of each cast iron) with subsequent welding to steel holders. 27 teeth of each type were consumed for every test cycle conducted in burden removing on layers containing quartzitic sandstone. Wear resistance was assessed by wear scar width on the back edge of each tooth. When the width of said scar reached 35 mm, the worn tooth was discarded and replaced with a new one of the same type.

The coefficient of relative impact and abrasive wear resistance Ψ was determined from the formula $$\psi = \frac{N_s}{n_{wci}},$$

where $N_s$ is the number of replaced teeth with working portions made from Sormite 1

$N_{wci}$ is the number of replaced teeth with working portions made from wear-resistant cast iron of the chemical composition according to the invention.

Test results are given in Table 2.

TABLE 2

| Characteristics and units of measurement | Wear-resistant cast iron of the present invention | Sormite 1 |
|---|---|---|
| Hardness, HRC | 48 to 52 | 48 to 50 |
| Cross-breaking strength, kgf/mm$^2$ | 74.7 | 71.8 |
| Bending deflection on specimen breakage, mm | 3.60 | 3.20 |
| Coefficient of relative abrasive wear resistance | 5.60 | 5.0 |
| Coefficient of relative impact and abrasive wear resistance | 1.9 | 1.0 |

EXAMPLE 2

Wear-resistant cast iron comprises the following ingredients (wt.%):

| | |
|---|---|
| carbon | 3.2 |
| silicon | 1.2 |
| manganese | 1.1 |
| chromium | 25.0 |
| nickel | 3.2 |
| titanium | 0.8 |
| iron and impurities | the balance |

The wear-resistant cast iron contains up to 0.05 wt.% of sulphur and up to 0.05 wt.% of phosphorus as controlled impurities.

The wear-resistant cast iron of the above indicated chemical composition is obtained from the charge comprising the following ingredients (wt.%):

| | |
|---|---|
| conversion cast iron | 14.2 |
| steel scrap | 41.5 |
| ferrochromium | 36.1 |
| ferromanganese | 1.1 |
| nickel | 2.8 |
| titanium | 4.3 |

To correct chemical composition of the wear-resistant cast iron on the basis of the data of rapid analysis of melt samples, it is possible to use ferrosilicon in an amount of 2% of the total mass of the above charge ingredients.

Chemical composition of the above charge ingredients is as given in Example 1 (Table 1).

Wear-resistant cast iron melting was performed in an induction furnace by the procedure similar to that described in Example 1.

By pouring into well dried sand-loam moulds the obtained wear-resistant cast iron was made into slab and rod shaped blanks 10 to 15 mm thick used further to produce, by electroslag remelting, specimens intended to be used for determining Rockwell hardness, cross-breaking strength, bending deflection of specimens on breakage, the coefficient of relative abrasive wear resistance, and the coefficient of impact and abrasive wear resistance.

The tests were conducted as described in Example I. Test results are given in Table 3.

TABLE 3

| Characteristics and units of measurement 1 | Wear-resistant cast iron of the invention 2 | Sormite 1 3 |
|---|---|---|
| Harndess, HRC | 50 to 53 | 48 to 50 |
| Cross-breaking strength, kgf/mm$^2$ | 72.3 | 71.8 |
| Bending deflection on specimen breakage, mm | 3.55 | 3.20 |
| Coefficient of relative abrasive wear resistance | 6.1 | 5.0 |
| Coefficient of relative impact and abrasive wear resistance | 2.0 | 1.0 |

EXAMPLE 3

Wear-resistant cast iron comprises the following ingredients (wt.%):

| | |
|---|---|
| carbon | 3.5 |
| silicon | 1.0 |
| manganese | 1.5 |
| chromium | 27.0 |
| nickel | 3.5 |
| titanium | 1.0 |
| iron and impurities | the balance to 100.0 |

This wear-resistant cast iron contains up to 0.07 wt.% of sulphur and up to 0.07 wt.% of phosphorus as controlled impurities.

Wear-resistant cast iron of the above indicated chemical composition is obtained from the slag comprising the following ingredients (wt.%):

| | |
|---|---|
| conversion cast iron | 14.8 |
| steel scrap | 38.6 |
| ferrochromium | 37.6 |
| ferromanganese | 1.3 |

-continued

| | |
|---|---|
| nickel | 3.0 |
| titanium | 4.7 |

To correct chemical composition of the wear-resistant cast iron on the basis of the data of rapid analysis of melt samples, it is possible to use ferrosilicon in an amount of 2% of the total mass of the above slag ingredients.

Chemical composition of the above charge ingredients is as given in Example I (Table I).

Wear-resistant cast iron melting was performed in an induction furnace by the procedure similar to that described in Example I.

By pouring into well dried sand-loam moulds the obtained wear-resistant cast iron was made into slab and rod shaped blanks 10 to 15 mm thick used further to produce, by electroslag remelting, specimens intended to be used for determining Rockwell hardness, cross-breaking strength, bending deflection of specimens on breakage, the coefficient of relative abrasive wear-resistance, and the coefficient of relative impact and abrasive wear resistance.

The tests were conducted as described in Example 1. Test results are given in Table 4.

TABLE 4

| Characteristics and unit of measurement | Wear-resistant cast iron of the invention | Sormite 1 |
|---|---|---|
| Hardness, HRC | 52 to 55 | 48 to 50 |
| Cross-breaking strength, kgf/mm$^2$ | 71.0 | 71.0 |
| Bending deflection on specimen breakage, mm | 3.42 | 3.20 |
| Coefficient of relative abrasive wear resistance | 6.45 | 5.0 |
| Coefficient of relative impact and abrasive wear resistance | 2.2 | 1.0 |

It will be apparent to those skilled in the art that the ingredient concentrations of the wear-resistant cast iron may be other than those indicated in the above typical embodiments of the invention described hereinabove provided that particular ingredient concentrations are within the spirit of the invention and the scope of the claims.

What is claimed is:

1. Wear-resistant cast iron consisting essentially of the following ingredients (wt.%):

| | |
|---|---|
| carbon | from 3.0 to 3.5 |
| silicon | from 0.6 to 1.5 |
| manganese | from 0.8 to 1.5 |
| chromium | from 23.0 to 27.0 |
| nickel | from 3.0 to 3.5 |
| titanium | from 0.6 to 1.0 |
| iron and impurities | the balance |

* * * * *